United States Patent [19]

Brown et al.

[11] 4,188,896

[45] Feb. 19, 1980

[54] DIAPHRAGM PUMP FOR NEEDLE THREADING

[75] Inventors: Jack Brown, Union; John A. Herr, Garwood; Wolfgang Jaffe, Roselle Park; Wesley R. Peterson, Bound Brook, all of N.J.

[73] Assignee: The Singer Company, New York, N.Y.

[21] Appl. No.: 907,654

[22] Filed: May 22, 1978

[51] Int. Cl.[2] ..... D05B 87/00; F04B 17/04

[52] U.S. Cl. ..... 112/225; 112/302; 417/413

[58] Field of Search ..... 112/225, 302; 417/411, 417/413; 318/132, 134; 310/17

[56] References Cited

U.S. PATENT DOCUMENTS

| | | | |
|---|---|---|---|
| 2,144,662 | 1/1939 | Paasche | 417/413 X |
| 2,363,478 | 11/1944 | Boeke | 417/413 X |
| 2,669,937 | 2/1954 | Presentey | 417/413 |
| 3,515,966 | 6/1970 | De Valroger et al. | 417/413 X |
| 3,599,587 | 8/1971 | Greulich | 112/225 |
| 3,950,761 | 4/1976 | Kashio | 417/413 X |

*Primary Examiner*—Peter P. Nerbun

*Attorney, Agent, or Firm*—Robert E. Smith; Edward L. Bell

[57] ABSTRACT

A pump is disclosed having a housing with a recess therein, an elastomeric diaphragm stretched across said recess forming a pump cavity in which the medium being pumped is circulated, and inlet and outlet valves. An electronically controlled linear actuator is attached to the diaphragm within the pump cavity thereby allowing compactness in the construction of the pump and improved heat dissipation from the linear actuator. The pump fits within the frame of a sewing machine and creates an air vacuum for assisting in needle threading.

7 Claims, 5 Drawing Figures

DIAPHRAGM PUMP FOR NEEDLE THREADING

BACKGROUND OF THE INVENTION

This invention relates to diaphragm pumps, and in particular, to those pumps mountable within a sewing machine for use with a pneumatic needle threading assist.

Needle threading is a desirable feature to have on a sewing machine. Of the various types of needle threaders available, pneumatic needle threaders, as described in U.S. Pat. No. 3,486,472 of R. M. Kaplan, uses an air vacuum to pull the thread end through the eye of a sewing needle. While a manual pump may be used to supply the air vacuum, diaphragm pumps are available for this purpose having an actuating mechanism external to the pump itself. Bearing in mind the limited amount of space within the frame of a sewing machine, it becomes necessary to mount the pump and its actuating mechanism outside of the sewing machine frame, which in the case of industrial machines is acceptable. However, with respect to household sewing machines, it is desirable to mount the entire pump mechanism within the frame of the sewing machine.

SUMMARY OF THE INVENTION

An object of this invention is to provide a diaphragm pump compact enough to fit within the frame of a sewing machine. This object is achieved by a pneumatic pump having a housing with an open recess therein, the recess being closed by a diaphragm, means through which a pumping medium may enter and exit the recess, and means within the recess for oscillating the diaphragm.

A further object of this invention is to provide for effective heat dissipation from the linear actuator by circulating the pumped medium thereover.

DESCRIPTION OF THE DRAWINGS

With the above and additional objects and advantages in view as will hereinafter appear, the invention will be described with reference to the drawings of the preferred embodiment in which.

DESCRIPTION OF THE PREFERRED EMBODIMENT

Figure 1:
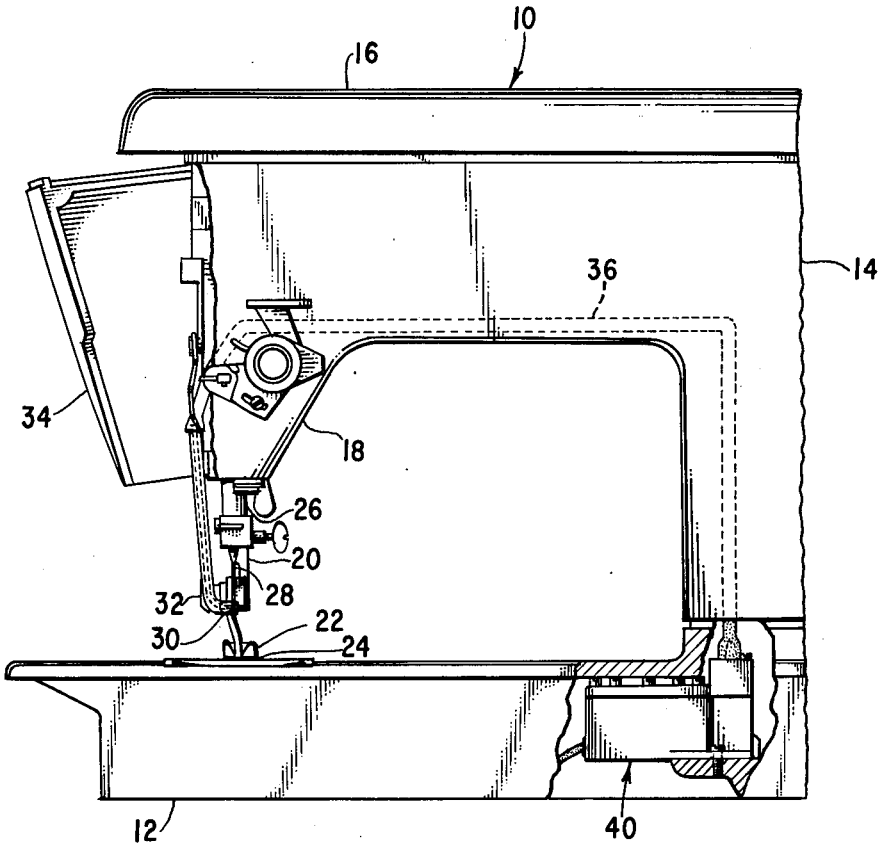
FIG. 1 is a front elevational view, partly in section, of a sewing machine showing the invention incorporated therein.

As shown in FIG. 1, a sewing machine is generally referred to by the reference 10. The sewing machine 10 includes a bed 12, a hollow standard 14 extending upwardly from the bed 12, and a bracket arm 16 projecting horizontally from the standard 14 overhanging the bed 12 and terminating in a sewing head 18. A downwardly biased presser bar 20 is carried in the sewing machine and has removably attached thereto a presser foot 22 for urging the material being sewn into engagement with a feed mechanism as evidenced by feed dog

24. A needle bar 26 is also carried within the sewing head 18 and is arranged for substantially vertical reciprocatory motion. A sewing needle 28 having a thread carrying needle eye 30 is removably mounted to the end of the needle bar 28. For assisting in the threading of the needle eye 30, a pneumatic needle threader assist 32 is carried in the sewing head 18 and may be stored therein, accessing the same through a door 34 pivotally mounted to the sewing head 18. The pneumatic needle threader assist 32, which may be substantially similar to the one disclosed in U.S. Pat. No. 3,486,472 of R. M. Kaplan to which reference may be had for greater detail, includes a pneumatic vacuum line 36 carried in the bracket arm 16 and the standard 14 and terminating at the diaphragm pump 40 of this invention.

The diaphragm pump 40 includes a housing 42 having vertical side walls 44 and a base 46 defining two intersecting cavities, a cylindrical pump cavity 48 and a rectangular valve cavity 50. A cylindrical electrical coil 52, having a central opening 54 therein, is mounted to the base 46 centrally located within the pump cavity 48. Two lead wires 56, connected to the coil 52, exit from the pump cavity 48 through a hole 58 formed in the wall 44 of the housing 42. An annular ring 60 having a central bore 62 is fitted within the coil central opening 54 and includes a plurality of axial recess 64 therein for housing bar magnets 66 each of which has been magnetized through the thickness thereof and positioned in each of said recesses 64 such that the same pole of each magnet 66 faces the central bore 62 of the annular ring 60. A cap 68 is provided for covering the recesses 64 thereby capturing the magnet 66 therein. The cap 68 is formed with a central hole 70 which is coaxial with, and of the same diameter as, the central bore 62 of the annular ring 60. The coil 52 may be enclosed in a casing 72 rendering the coil 52 along with the magnets 66 impervious to the medium being circulated through the pump 40.

A diaphragm support plate 74 is mounted over the housing 42 and includes an opening 76 therein congruent to the pump cavity 48 and two circular holes 78 overlying the valve cavity 50. A support post 80 is mounted to the housing base 46 mid-way the intersection of the pump cavity 48 and the valve cavity 50 and extends upwardly to provide additional support to the diaphragm support plate 74.

An elastomeric diaphragm 82 overlies the diaphragm support plate 74 and has an overall shape generally congruent to the outline of the support plate 74. An armature 84 is mounted to the diaphragm 82 by a screw 86 passing through a hole 88 formed in the diaphragm 82 sandwiched between two washers 90. The armature 84 is located on the diaphragm 82 such that it is coaxial with the central bore 62 of the annular ring 60 mounted in the housing 42, and to this end, the armature 84 is slidably received by said central bore 62. The armature 84 along with the magnets 66 and the coil 52 form the linear actuator for vibrating the diaphragm 82 of this invention. The diaphragm 82 is also formed with two holes 92 which are coaxial with and of substantially the same diameter as the holes 78 in the support plate 74.

Overlying the diaphragm 82 is a clamping plate 94. The clamping plate 94 has a circular opening 96 therein coaxial with the housing pump cavity 48. A rectangular section 98 of the clamping plate 94 covers the holes 92 and 78 in the diaphragm 82 and the support plate 74, respectively. Carried within the rectangular section 98 is the valve assembly 100 including inward and outward ports, 102 and 104 respectively, a butterfly valve 106 and a valve retainer 108 held in place by screw 110. Screws 112 are used to fasten the clamping plate 94, the diaphragm 82 and the support plate 74 to the pump housing 42 and for this purpose pass through holes 114 formed in each of the parts.

As can be seen in the foregoing description, the base 46 of the housing 42 forms a structural support for the linear actuator thereby precluding the need for external supporting means. This enables the manufacturing of a diaphragm pump which occupies a significantly smaller volume than the pumps found in the prior art. Also with the linear actuator located within the pump cavity 48, the pumped medium, as it circulates within the pump cavity 48, carries heat away from the linear actuator thereby giving improved heat dissipation therefor.

Figure 5:
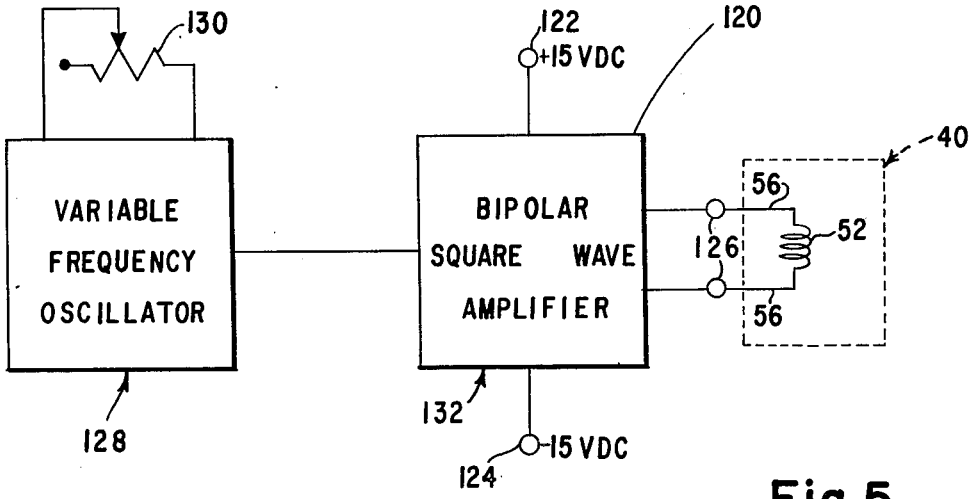
FIG. 5 is a schematic, in block diagram form, of an electronic circuit which may be used with the invention.
Figure 2:
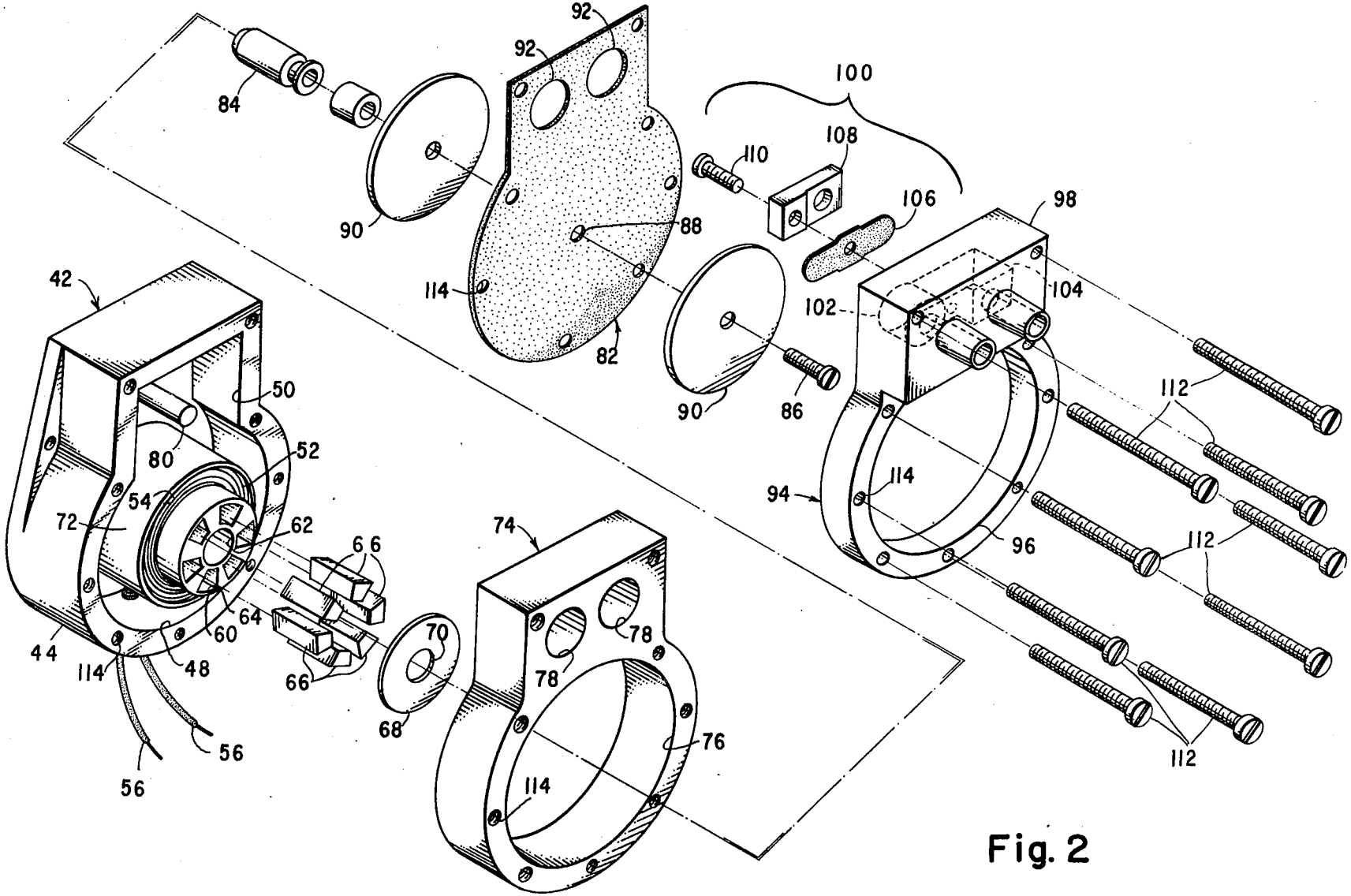
FIG. 2 is an exploded perspective view of one embodiment of the invention.

An electronic circuit 120, shown in block diagram form in FIG. 5, may be used for driving the linear actuator in the diaphragm pump 40. The circuit 120 requires both a plus and a minus 15 volt D.C. input at terminals 122 and 124 respectively, and supplies a variable frequency plus and minus 15 volts square wave output at terminals 126 to the lead wires 56, connected to the electrical coil 52 of the linear actuator in the pump 40. The electronic circuit 120 includes a variable frequency oscillator 128 of known design controlled by a variable resistor 130 to vary the frequency from 4 to 200 hertz and a bi-polar square wave amplifier 132, preferrably solid state, also of known design. The variable resistor 130 allows the operating frequency to be adjusted to attain optimum performance. This optimum frequency varies dependent upon such factors as the size of the diaphragm 82 in relation to the volume of the pump cavity 48, the natural frequency of the diaphragm 82 and the linear actuator, and the orifice size in the needle threading assist 32. Once these design parameters have been established, the variable resistor 130 may be replaced with one having an optimized fixed valve.

An advantage in using a square wave output, which is in essence a switching constant voltage output, lies in the fact that in a low inductance circuit, the output voltage is proportional to the output current. By keeping the output current at a maximum during each phase of the output cycle, a maximum amount of force is transmitted through the linear actuator to the pump diaphragm 82 thereby allowing for highly efficient operation. Also, by using a square wave output, the output transistors of the amplifier 132 may be chosen such that they are either saturated or turned off. When operated as so described, the output transistors are most efficient and dissipate a minimum amount of power thereby allowing the use of less expensive components and reducing the input power demand of the electronic circuit 120.

Figure 4:
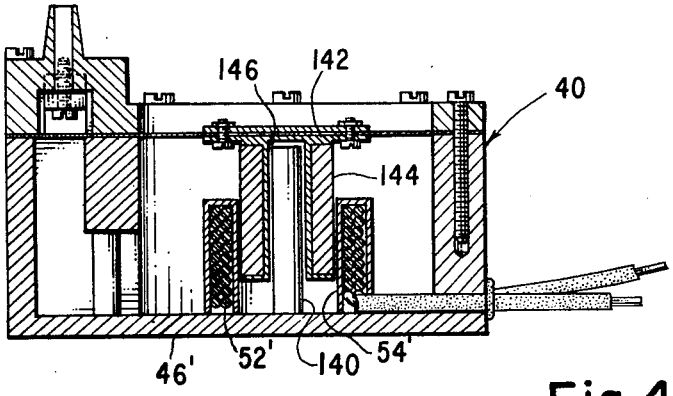
FIG. 4 is a full cross-sectional view of another embodiment of the invention.
Figure 3:
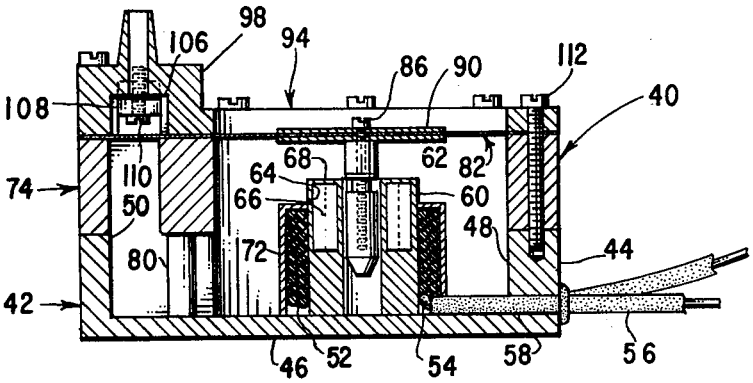
FIG. 3 is a full cross-sectional view of the embodiment shown in FIG. 2.

FIG. 4 shows a second embodiment of a diaphragm pump 40 wherein the linear actuator uses a wrap around flexible magnet on the armature as described in U.S. Pat. No. 4,065,739 of Jaffe et al. In this embodiment, a shaft 140, of magnetizable material, is mounted to the base 46' and extends vertically therefrom along the central axis of the coil 52'. A plastic spool 142 mounted to the diaphragm 82', has mounted thereto a flexible magnet 144, magnetized through the thickness thereof. The spool 142 has a hole 146 formed therein and is arranged to slidably move along the shaft 140 within the central opening 54' of the coil 52'.

Numerous alterations of the structure herein disclosed will suggest themselves to those skilled in the art. However, it is to be understood that the present disclosure relates to a preferred embodiment of the invention which is for the purpose of illustration only and not to be construed as a limitation of the invention. All such modifications which do not depart from the spirit of the invention are intended to be included within the scope of the appended claims.

Having thus set forth the nature of the invention, what we herein claim is:

1. A diaphragm pump comprising:

a housing having a recess therein;

means defining an opening through said housing into said recess;

an elastomeric diaphragm having a shape congruent with the opening to said housing recess;

means for attaching said diaphragm to said housing spanning said recess opening and defining with said recess a pump cavity;

means communicating with said pump cavity for alternately allowing a pumped medium to enter and exit said pump cavity in response to movement of said diaphragm; and drive means including an electric motor means supported and arranged within said pump cavity for oscillating said diaphragm.

2. A diaphragm pump as set forth in claim 1 wherein said means communicating with said pump cavity comprises inlet and outlet one-way valves.

3. A diaphragm pump as set forth in claim 1 wherein said drive means for oscillating said diaphragm comprises an electrically operated linear actuator and circuit means for actuating said linear actuator including electric conductor means extending into said pump cavity.

4. A diaphragm pump as set forth in claim 3 wherein said circuit means for actuating said electrically operated linear actuator includes an electronic circuit capable of producing an alternating electric current in a square wave output.

5. A diaphragm pump as set forth in claims 3 or 4 wherein said linear actuator includes a non-magnetic spool having an axis substantially parallel to the linear path of movement of said linear actuator and a flexible magnet through the thickness thereof and wrapped on said spool.

6. In a sewing machine having a needle bar arranged for reciprocatory motion, a sewing needle, having a thread bearing eye, attached to the end of said needle bar, and a pneumatic needle threader assist, a diaphragm pump housed within said sewing machine for providing an air vacuum to said threader assist, said pump comprising a housing having a recess therein, an elastomeric diaphragm spanning said housing recess defining a pump cavity, inlet and outlet valves communicating with said pump cavity, an electromechanical linear actuator supported and arranged within said pump cavity and attached to said diaphragm, an electronic control circuit for driving said linear actuator, and means for connecting said pneumatic needle threader assist to said inlet valve of said diaphragm pump.

7. A diaphragm pump comprising:

a housing formed with a recess having cylindrical walls, said housing having a circular opening at one end of said recess and an end closure arranged across said side walls at the other end of said recess;

an elastomeric diaphragm secured in spanning relation across said opening to close said recess and define therein a pump cavity;

valve means communicating with said pump cavity and controlling the flow of pumped medium into and out thereof; and drive means operatively connected to said diaphragm and including an electrically operated actuator means secured within said pump cavity to said end closure of said recess.

* * * * *